US009117385B2

(12) United States Patent
Todd et al.

(10) Patent No.: US 9,117,385 B2
(45) Date of Patent: Aug. 25, 2015

(54) RESOLUTION MANAGEMENT FOR MULTI-VIEW DISPLAY TECHNOLOGIES

(75) Inventors: Craig Todd, Mill Valley, CA (US); Robin Atkins, Vancouver (CA)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 527 days.

(21) Appl. No.: 13/367,995

(22) Filed: Feb. 7, 2012

(65) Prior Publication Data

US 2012/0200593 A1 Aug. 9, 2012

Related U.S. Application Data

(60) Provisional application No. 61/440,965, filed on Feb. 9, 2011.

(51) Int. Cl.
*G09G 5/00* (2006.01)
*G09G 3/00* (2006.01)

(52) U.S. Cl.
CPC ..... *G09G 3/003* (2013.01); *G09G 2340/0407* (2013.01); *G09G 2354/00* (2013.01)

(58) Field of Classification Search
None
See application file for complete search history.

(56) References Cited

U.S. PATENT DOCUMENTS

| | | | | |
|---|---|---|---|---|
| 5,855,425 | A | 1/1999 | Hamagishi | |
| 6,061,084 | A | 5/2000 | Perlin | |
| 6,215,590 | B1 | 4/2001 | Okano | |
| 6,239,830 | B1 | 5/2001 | Perlin | |
| 8,316,254 | B2 * | 11/2012 | Kaneko et al. | 713/323 |
| 2003/0035007 | A1 * | 2/2003 | Wugofski | 345/764 |
| 2005/0078108 | A1 | 4/2005 | Swift | |
| 2005/0259147 | A1 * | 11/2005 | Nam et al. | 348/43 |
| 2006/0279750 | A1 | 12/2006 | Ha | |
| 2007/0165013 | A1 | 7/2007 | Goulanian | |
| 2007/0258139 | A1 | 11/2007 | Tsai | |
| 2007/0291179 | A1 * | 12/2007 | Sterling et al. | 348/642 |
| 2009/0046037 | A1 | 2/2009 | Whitehead | |
| 2010/0073465 | A1 | 3/2010 | Park | |
| 2010/0275047 | A1 * | 10/2010 | Kaneko et al. | 713/323 |

(Continued)

FOREIGN PATENT DOCUMENTS

| | | |
|---|---|---|
| WO | 2009095862 | 8/2009 |
| WO | 2010049868 | 5/2010 |
| WO | 2010084326 | 7/2010 |

OTHER PUBLICATIONS

Fehn, C., et al., "Interactive 3-DTV-Concepts and Key Technologies" Proceedings of the IEEE, vol. 94, No. 3, Mar. 2006, pp. 524-538.

(Continued)

*Primary Examiner* — Sath V Perungavoor
*Assistant Examiner* — Dakshesh Parikh

(57) ABSTRACT

Embodiments of the invention relate to multiview displays. Methods and apparatus are provided for receiving input parameters, evaluating the input parameters to determine resolution settings within the display constraints, and outputting the resolution settings to the multiview display to control display of image data. The resolution settings include color, temporal, spatial and view resolutions. The input parameters include viewer tracking information and content information associated with the image data. Some embodiments provide for determination of view resolution and/or power settings for the display based on viewer tracking information.

16 Claims, 5 Drawing Sheets

(56) References Cited

U.S. PATENT DOCUMENTS

| | | | | |
|---|---|---|---|---|
| 2010/0315324 | A1* | 12/2010 | Nam et al. | 345/102 |
| 2011/0164188 | A1* | 7/2011 | Karaoguz et al. | 348/734 |

OTHER PUBLICATIONS

Microsoft Applied Sciences Group, "The Wedge" 2010 Microsoft Corporation.

Large, M.J., et al., "Parallel Optics in Waveguide Displays: A Flat Panel Autostereoscopic Display" Sep. 25, 2009, Microsoft Applied Sciences Group and Microsoft Hardware, pp. 1-7.

Travis A., et al., "Backlight for View-Sequential Autostereo 3D" Microsoft E&DD Applied Sciences.

Travis, A., et al., "Collimated Light from a Waveguide for a Display Backlight" Oct. 26, 2009, vol. 17, No. 22, Optics Express, pp. 19714-19719.

Travis, A., et al., "The Design of Backlights for View-Sequential 3D" Microsoft Corporation.

* cited by examiner

ALL VIEWS DISPLAYED

DECREASED FIELD OF VIEW (INCREASED IMAGE QUALITY)

FOR 2D DISPLAY, ALL VIEWS HAVE SAME HIGH-QUALITY IMAGE

3D IMAGES REQUIRE TWO VIEWS (DECREASED IMAGE QUALITY)

RESOLUTION MANAGEMENT FOR MULTI-VIEW DISPLAY TECHNOLOGIES

CROSS-REFERENCE TO RELATED APPLICATIONS

This application claims priority to U.S. Provisional Patent Application No. 61/440,965 filed 9 Feb. 2011, which is incorporated herein by reference in its entirety.

TECHNICAL FIELD

This invention relates to multiview displays which can display multiple views within a viewing area.

BACKGROUND

Multiview displays are operable to display multiple views of an image. The views are directed to different locations within a viewing area. A multiview display can be used to generate a three-dimensional (3D) visual effect by displaying two or more views to a person viewing the display (i.e. viewer or observer) to create the perception of depth. For example, left and right views representing different perspectives of a scene or object may be directed to the left and right eyes of the viewer, respectively. As the views are spatially separated, the viewer does not need to wear viewing eyeglasses to view the left and right images displayed by a multiview display.

Some multiview displays can display two views (e.g. left and right views). Such displays may be suitable for viewing by a single viewer. Other multiview displays can display more than two views. Such multiview displays can repeat sets of left and right views over a range of viewing positions within the viewing area so that the same 3D image can be observed by a viewer located at one of the viewing positions. In other cases, multiview displays can display images representing different perspectives of a scene or object so that a viewer observes the scene or object from different perspectives when moving from place to place.

A multiview display may be constructed from a flat panel display or projection display having a light source, such as, for example, a liquid crystal display (LCD), digital light projector (DLP) display, liquid crystal on silicon (LCOS) display, organic light-emitting diode (OLED) display, high-dynamic range (HDR) display, plasma display, or the like. An optical layer or filter may be provided with such displays to direct light for an image to different locations in the viewing area. In some multiview displays the optical layer comprises a parallax barrier which blocks light in particular directions so that for a given viewing angle only certain parts of the image can be viewed. In other multiview displays the optical layer comprises a plurality of micro-lenses (e.g. lenticular lenses) for refracting the light. The lenses may be adapted to direct the light to different locations along a horizontal direction, or along horizontal and vertical directions, for example.

Some multiview displays have an optical layer comprising active optical steering elements (e.g. switchable parallax barrier, displaceable lenses, and the like). An example of such a display is described by Goulanian et al. in US Patent Application Publication No. 2007/0165013 titled "Apparatus and System for Reproducing 3-Dimensional Images."

In addition to the above-noted technologies, other technologies exist for directing light in particular directions to display multiple views within a viewing area.

A problem that the inventors have identified in relation to multiview displays is that increasing the number of views may lead to a degradation of the image quality given the display constraints. It is desirable to provide a multiview display system which can be adapted for different viewing circumstances. Such adaptable displays may provide improved viewing experiences to viewers.

It is also desirable to provide a multiview display that is energy efficient.

The foregoing examples of the related art and limitations related thereto are intended to be illustrative and not exclusive. Other limitations of the related art will become apparent to those of skill in the art upon a reading of the specification and a study of the drawings.

SUMMARY

Aspects of the invention provide methods, apparatus and systems for adjusting color, temporal, spatial and/or view resolutions for a multiview display to provide an improved viewing experience for the particular viewing circumstances. According to one embodiment, a resolution management system uses inputs such as viewer tracking information from a viewer position tracking system and source image content to dynamically determine appropriate settings for each of the color, temporal, spatial and/or view resolutions. These settings are output to the multiview display to control the display of image data by the display.

In one embodiment, where views are not being observed, the number of views may be decreased to reduce power consumption. In other embodiments, input from the viewer position tracking system may be used to adjust view, color, temporal and/or spatial resolution, based on factors such as the number of views being observed, or whether a viewer is moving or stationary.

In addition to the exemplary aspects and embodiments described above, further aspects and embodiments will become apparent by reference to the drawings and by study of the following detailed descriptions.

DESCRIPTION

Figure 1:
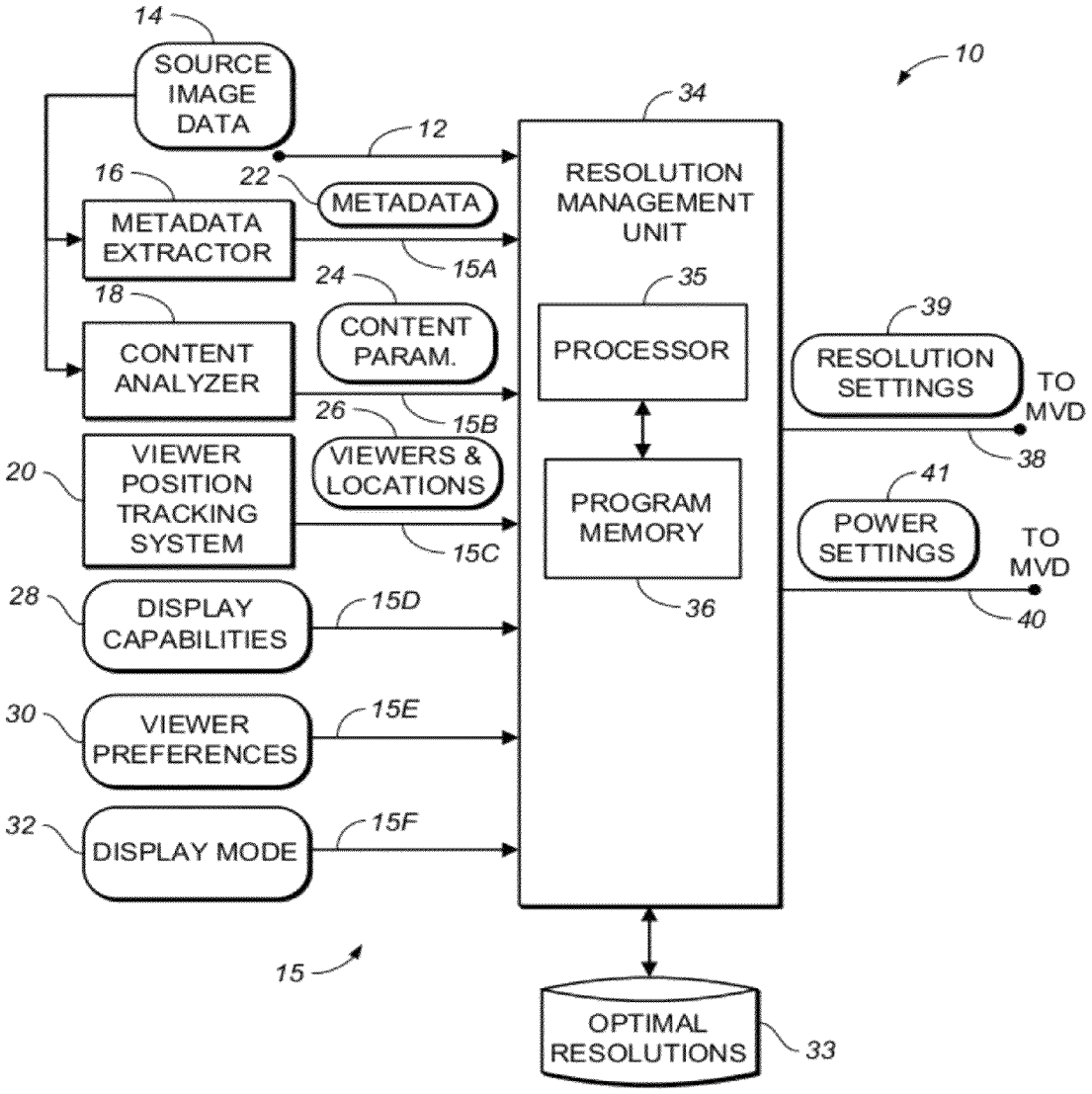
FIG. 1 is a schematic illustration of a resolution management system for a multiview display according to one example embodiment.

Throughout the following description, specific details are set forth in order to provide a more thorough understanding to persons skilled in the art. However, well known elements may not have been shown or described in detail to avoid unnecessarily obscuring the disclosure. Accordingly, the description and drawings are to be regarded in an illustrative, rather than a restrictive, sense.

The viewing experience or quality of images provided by a multiview display (MVD) can be affected by the image resolution. For an MVD there are several types or axes of image resolution: (1) color resolution (e.g. color depth that can be displayed, which can be 4 bit, 8 bit, 10 bit color, for example); (2) temporal resolution (e.g. frame rate, such as 30 Hz, 60 Hz, 120 Hz); (3) spatial resolution (e.g. a measure of how closely lines can be resolved, e.g. 720 p, 1080 p); and (4) view resolution (e.g. number of views, such as 1 view, 2 views, 40 views, etc.). The total image resolution N of an MVD can be described by:

$$N=f(C, T, S, V) \quad \text{Equation [1]}$$

where C is color resolution, T is temporal resolution, S is spatial resolution and V is view resolution (i.e. the number of views of the display). A particular MVD may have a fixed total image resolution N but may have the ability to vary resolutions C, T, S and V, where C, T and S are referenced to each view (i.e. each view is represented with a certain color, temporal and spatial resolution). The particular relationship between N and resolutions C, T, S and V may vary according to the display.

Due to hardware constraints of an MVD and/or bandwidth constraints (e.g. the rate at which image data can be supplied to or from a decoder, set-top box, display processor, or other device in the video delivery pipeline), increasing the view resolution (number of views) of an MVD can come at a cost, such as the necessity to make a corresponding decrease in color, temporal and/or spatial resolution for each view. This can have the effect of degrading image quality. It may only be possible to increase the color, temporal and/or spatial resolution for one or more particular views if the number of views is decreased.

Embodiments described herein provide methods, apparatus and systems for managing trade-offs between color, temporal, spatial and/or view resolutions for an MVD to provide an improved viewing experience for the particular viewing circumstances. According to particular embodiments, a resolution management system uses inputs such as source image content and viewer tracking information (e.g. number and location of viewers) to dynamically determine appropriate settings for each of the color, temporal, spatial and/or view resolutions. These settings are output to the MVD to control the display of image data by the MVD.

Some embodiments described herein provide methods, apparatus and systems for controlling the view resolution (number of views), related view resolution settings and/or power settings in response to the number and position of viewers. For example, a resolution management system may output a signal to the MVD to selectively disable views that are not currently being observed. In particular embodiments, a light source of the display may be dimmed or disabled, or turned off for part of the time, if one or more of the views is not being observed. This reduces the power consumption of the MVD. In some embodiments, where views are not being observed, the number of views may be decreased while increasing other types of resolution of each view such as color, temporal and/or spatial resolution so as to improve the viewing experience for the viewers.

FIG. 1 schematically illustrates a resolution management system 10 that may be used with an MVD (not shown) according to an example embodiment. The MVD may be a television, computer monitor, home cinema display, a dedicated display on devices such as tablet computers, mobile devices, game consoles, e-book readers, or the like, or a specialized display such as a display for medical imaging, virtual reality, vehicle simulation, advertising or the like. The MVD may be based on any suitable display technology such as LCD, DLP, LCOS, OLED, HDR, or plasma display technology, or the like, in combination with a mechanism such as an optical layer or filter for directing light for an image to multiple locations in a viewing area. The optical layer may include active optical steering elements such as switchable parallax barrier, displaceable lenses, or the like.

Resolution management system 10 comprises a resolution management unit 34. Resolution management unit 34 comprises an input 12 for receiving source image data 14 to be displayed. In the FIG. 1 embodiment, resolution management unit 34 determines resolution settings 39 and power settings 41 for source image data 14. Resolution management unit 34 has outputs 38, 40 for carrying resolution settings 39 and power settings 41, respectively, to the MVD. The FIG. 1 embodiment shows both resolution settings 39 and power settings 41 but this is not necessary and in other embodiments, resolution management unit 34 may determine only one of resolution settings 39 and power settings 41.

In the FIG. 1 embodiment, resolution management unit 34 has one or more additional inputs 15A-15F (collectively, inputs 15) capable of receiving signals that may be used to control the determination of one or more resolution settings 39 and/or power settings 41.

Inputs 15 of the FIG. 1 embodiment include:

- a metadata input 15A for receiving, from a metadata extractor 16, metadata 22 specifying one or more aspects of a creative intent or characteristics of the source content that affect how source image data 14 ought to be displayed;
- one or more content parameter inputs 15B for receiving, from an image content analyzer 18, one or more content parameters 24 specifying one or more characteristics of the source content that may affect how source image data 14 ought to be displayed;
- a viewer location input 15C for receiving, from a viewer position tracking system 20, information 26 concerning the number of persons (viewers) within a viewing area and/or the locations of viewers;
- a display capability input 15D for receiving information 28 regarding the capabilities of the MVD on which the source image data is to be displayed;
- a viewer preferences input 15E for receiving viewer preference settings 30; and
- a display mode input 15F for receiving information regarding a current display mode 32 of the MVD.

Information carried in signals received at inputs 15 may be provided in any suitable way. For example, metadata 22 received at input 15A may be provided in a video signal carrying source image data 14, and may be extracted from the video signal by a metadata extractor 16 as seen in FIG. 1. The metadata may be embedded in the image data by any suitable means or may be provided in a separate file, a separate part of a data structure, or a separate communication path. Metadata 22 associated with source image data 14 may provide characteristics of the source content.

Content parameters 24 received at input 15B may be provided by a content analyzer 18 as seen in FIG. 1. Content analyzer 18 may analyze source image data 14 to determine one or more characteristics of the source content, such as, for example: an indication of whether the content is for 2D, 3D or multiview display; an indication of the general type of content (e.g. movie, news, animation, sports, games, etc.); an indication of the temporal or spatial resolution of the content; a measure of the similarity between different views; a measure of the similarity with previous frames; a measure of the image smoothness; a measure of the motion in the video image; source content gamut; image histogram; and the like. In certain embodiments, content analyzer 18 may have access to an online or local database (not shown) to determine optimal properties for a given content stream. Content analyzer 18 may be omitted in some embodiments.

Viewer information 26 received at input 15C may be provided by a viewer position tracking system 20 as seen in FIG. 1. Viewer position tracking system 20 may comprise an image acquisition system (e.g. one or more cameras) and an image processing system for determining the presence, location and/or viewing angle of viewers in a viewing area. Viewer position tracking system 20 may, for example, indicate that there is a single viewer, who is stationary at a particular location, with eyes at a certain angle from the display normal. Viewer position tracking system 20 may monitor the viewers' movements and may provide updated viewer information 26 at periodic intervals and/or when a change in the number and/or location of viewers is detected.

Display capability information 28 received at input 15D may be provided by the MVD. Display capability information 28 may comprise extended display identification data (EDID), configuration information and/or other data describing the capabilities of the display (e.g. spatial resolution, dynamic range, gamut, maximum number of views, maximum temporal resolution or frame rate, maximum color depth, maximum spatial resolution or maximum color depth for each view when displaying a particular number of views, etc.).

Viewer preference settings 30 received at input 15E may be provided by a user interface module (not shown) through which an operator of the display may indicate particular viewing preferences. Viewing preferences may include, for example, the number of views, a desired viewing mode (e.g. vivid, cinema, standard, professional, etc.), an indication of the desired priority levels for color, temporal, spatial and/or view resolution, or the like.

Display mode 32 received at input 15F may be provided by the MVD. Display mode 32 may indicate, for example, whether the MVD is operating in 2D or 3D mode, or single-view or multiview mode.

Some embodiments may not include all of inputs 15 of the FIG. 1 embodiment. For example, in some embodiments, one or more of metadata extractor 16, content analyzer 18 and viewer position tracking system 20 is omitted, and therefore any corresponding inputs (i.e. 15A, 15B and 15C) are not required. In some embodiments, input 15E for receiving viewer preferences 30 is not provided.

In the FIG. 1 embodiment, resolution management unit 34 has a processor 35 which receives and processes signals received at inputs 12 and 15A-15F, and determines resolution settings 39 and/or power settings 41 based on the input parameters. Resolution management unit 34 may have access to a database 33 storing optimal resolution settings, which may be used by processor 35 to determine resolution settings 39 for a given set of input parameters.

In certain embodiments, resolution settings 39 may include, for example, settings directed to one or more of: color resolution C, temporal resolution T, spatial resolution S and view resolution V. In some implementations, S may vary depending on the number of views (and other resolutions). For example, for 2 views, the spatial resolution of each view may be 1080 p, and at 4 views the spatial resolution of each view may be 720 p. In other implementations, spatial resolution S is fixed for the display, and resolution settings 39 are determined only for temporal resolution T, color resolution C and view resolution V. Other implementations may have other constraints.

Settings associated with view resolution V may include the number of views, view direction, field of view, angular separation between views, and the like. For example, the display could generate a 20° viewing angle, with only a single view, or an 80° viewing angle with a single view. The 20° viewing angle may consume less power, and the 80° viewing angle may be watched by more viewers. Such settings are described in further detail below with reference to FIG. 2.

Power settings 41 (FIG. 1) may comprise an indication to dim or disable, or intensify or enable one or more light sources. Where a light source is shared between multiple views (e.g. the light source sequentially illuminates each view, such as in some types of DLP displays), and where some of those views are not being observed by viewers, power settings 41 may comprise an indication to turn off the light source over the period(s) for views that are not being observed. Power settings 41 may cause the MVD to display only those views which are currently being observed by a viewer. Other types of displays in which power settings 41 may be adjusted in accordance with viewer tracking information include LED, OLED, plasma, FED, and SED displays. For example, in an LED display having multiple LEDs in the backlight, some of the LEDs may be switched on or off depending on the number of views being observed.

Processor 35 of FIG. 1 may comprise a central processing unit (CPU), one or more microprocessors, one or more FPGAs, image processing circuits, or any other suitable processing unit(s) comprising hardware and/or software configured for functioning as described herein. Processor 35 may implement the methods described herein (e.g. as described with reference to FIGS. 7 and 8) by executing software instructions provided by software functions. Such software functions may be stored in a program memory 36 as shown in FIG. 1, but this is not necessary and the software functions may be stored in other suitable memory locations within or accessible to processor 35. In some embodiments, one or more of the software functions or portions of the software functions may alternatively be implemented by suitably configured data processing hardware. In other embodiments one or more logic circuits are configured to perform the methods described herein as image data is supplied to the logic circuits.

Figure 2:
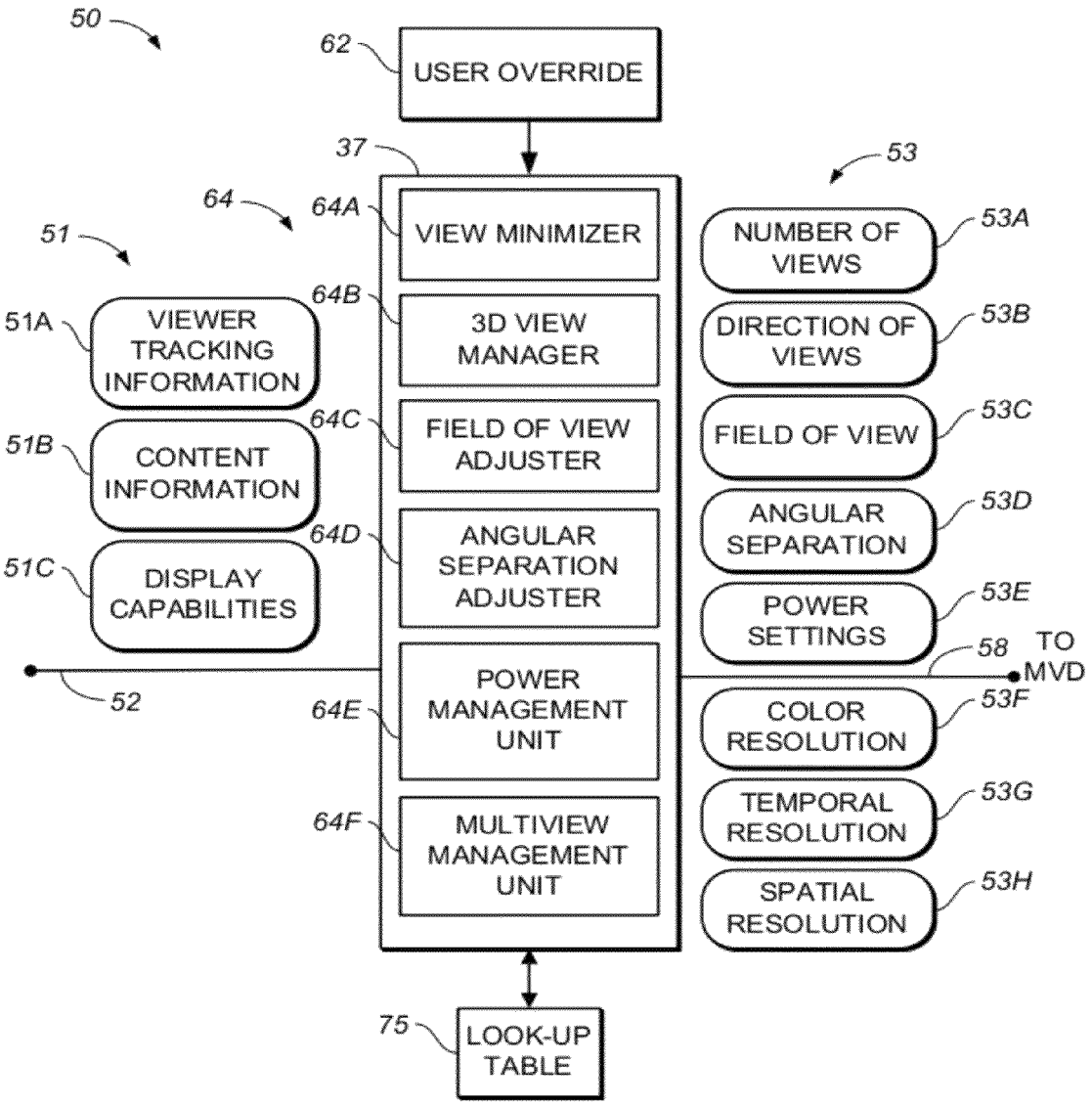
FIG. 2 is a schematic illustration of a specific implementation of a resolution management system for a multiview display according to another example embodiment.

FIG. 2 depicts a resolution management system 50 according to one implementation. Resolution management system 50 includes a resolution manager 37 which receives a plurality of parameters 51 from one or more inputs 52 and, based on parameters 51, determines a plurality of output settings 53 for an MVD (not shown). Output settings 53 are carried by one or more outputs 58 to the MVD.

User override control 62 is optionally provided to enable users to specify preferences for system resolutions. For example, a user may specify minimum resolution settings for each resolution type (color, temporal, spatial and/or view). A user may specify priority levels for one or more of the resolution types, so that, if trade-offs are to be made between the resolution types, the ones with the higher priority levels take precedence over the remaining types in the allocation of display hardware. A user may also specify particular resolution settings for one or more resolution types.

In the FIG. 2 embodiment, parameters 51 include:

viewer tracking information 51A such as the location of viewers, viewing angle, degree of movement of each viewer, and the like. Such information may be acquired from a viewer position tracking system similar to viewer position tracking system 20 as shown and described in relation to FIG. 1.

content information 51B such as whether the content is 2D, 3D or multiview; whether the content is movie, news, animation, sports, games, etc.; the temporal or spatial resolution of the content; a measure of the similarity between different views; a measure of the motion in the video image; and the like. Content information 51B may be provided by analyzing the content of the source image data (e.g. by way of a content analyzer 18 as shown and described in relation to FIG. 1), and/or from metadata in the source image data.

display capabilities 51C such as spatial resolution, maximum number of views, maximum temporal resolution or frame rate, maximum color depth, maximum spatial resolution or maximum color depth for each view when displaying a particular number of views, and the like.

In other embodiments, parameters 51 may include one or more of the same inputs 15 of the FIG. 1 embodiment (e.g. metadata, content parameters, viewer information, display capabilities, viewer preferences and/or display mode).

In the FIG. 2 embodiment, resolution manager 37 comprises a plurality of modules 64 for performing functions to determine output settings 53. Modules 64 may have access to a look-up table 75 specifying optimal resolution settings for a given set of parameters.

Figure 3A:
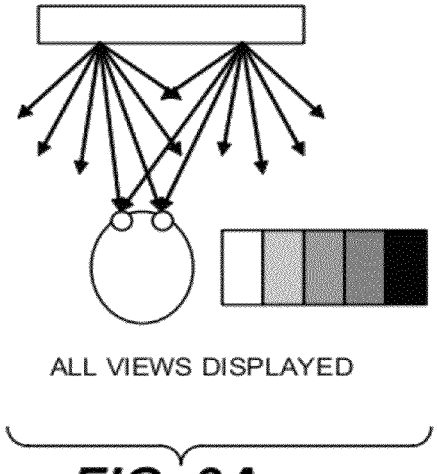
FIGS. 3A and 3B illustrate using viewer position tracking to adjust the number of views of a multiview display.
Figure 3B:
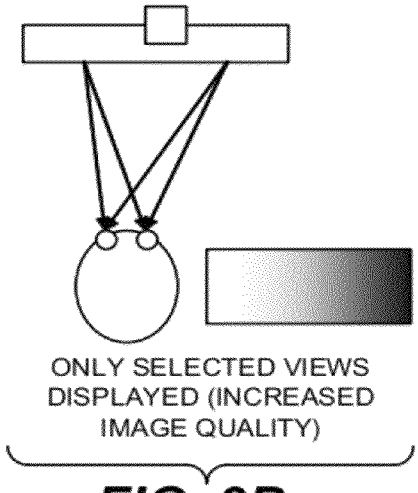

Modules 64 may include a view minimizer 64A which may provide control settings to the MVD to decrease the number of views displayed. The control settings may also improve certain aspects of the image quality for each remaining view, such as, for example, color resolution. As can be seen by comparing FIGS. 3A and 3B, for some displays if the number of views is reduced each view can be displayed having an increased color resolution. Such displays may include, for example, some types of DLP displays; OLED, plasma, LED, FED, or SED displays; or a display that is driven with a pulse-width modulation or pulse-code modulation control signal, or the like, provided in combination with a mechanism such as an optical steering mechanism for steering light to multiple locations in a viewing area. For example, suppose that, due to display hardware constraints, an MVD is capable of achieving a maximum color resolution C of 4 bits per color channel when displaying 45 views. This may result in poor color resolution for the image. If viewer tracking information 51A indicates that only a single viewer is observing the display, then it is not necessary to display all 45 views. By providing only the views necessary for a single viewer, the color resolution C may be increased to up to 10 bits per color channel within the constraints of the total resolution of the MVD.

Similar trade-offs can be made for temporal or spatial resolutions. For example, view minimizer 64A may decrease the number of views displayed to allow temporal and/or spatial resolution of each view to be increased. For a particular view resolution, the trade-offs between color, temporal or spatial resolution selected by view minimizer 64A may depend on one or more of the following parameters: content information 51B, display capabilities 51C and input from user override control 62.

After determining the number of views needed based on viewer tracking information 51A and other parameters, output settings 53 of view minimizer 64A may comprise one or more of: number of views 53A; direction of views 53B; and color resolution 53F, temporal resolution 53G, and/or spatial resolution 53H of each view. View minimizer 64A may use look-up table 75 to determine these output settings.

Figure 4A:
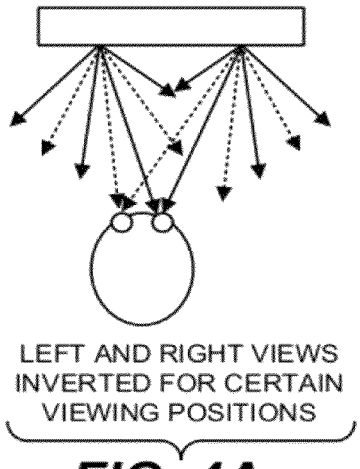
FIGS. 4A and 4B illustrate using viewer position tracking to provide left and right views for a 3D image displayed by a multiview display.
Figure 4B:
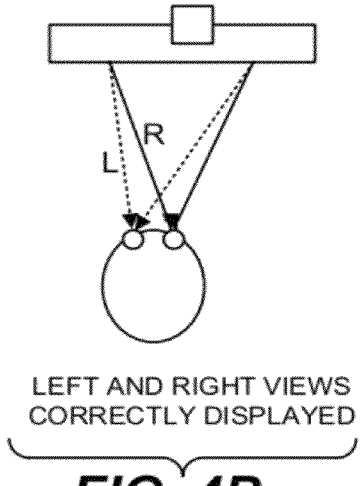

Modules 64 may include a 3D view manager 64B. During 3D image display, display of left and right views may result in inverted left and right views being viewed at certain viewing positions, as shown in FIG. 4A. To avoid viewers observing inverted left and right views, 3D view manager 64B may, in response to viewer tracking information 51A, generate control settings causing left and right views to be displayed to a viewing position so that they reach the left and right eyes of the intended viewer, respectively (see FIG. 4B). Any other views not currently being observed may be disabled. The output settings of 3D view manager 64B may comprise one or more of: number of views 53A; direction of views 53B; and power settings 53E (e.g. for turning off light sources for views not currently being observed).

Figure 5A:
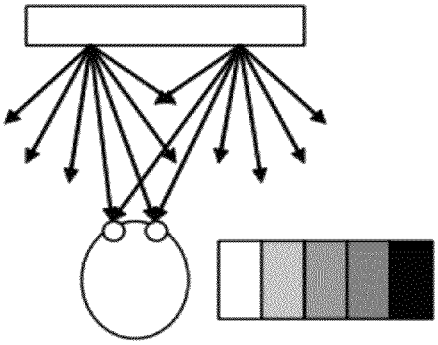
FIGS. 5A and 5B illustrate using viewer position tracking to adjust the field of view of a multiview display.
Figure 5B:
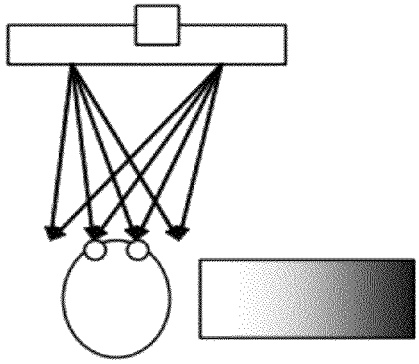

Modules 64 may include a field of view adjuster 64C. If, for example, viewer tracking information 51A indicates that a viewer is moving around within the viewing area, then it may be desirable to increase the field of view so that the viewer can view the same image from different positions. In that case, field of view adjuster 64C may generate control settings 53C which increase the field of view (see FIG. 5A). If viewer tracking information 51A indicates that a viewer is relatively static within the viewing area, then field of view adjuster 64C may generate control settings 53C which decrease the field of view (see FIG. 5B). A decreased field of view may in some cases allow certain aspects of the image quality to be improved.

The field of view may be the same for each view, or may be different for each view. An increased field of view for each view may result in an increase in the total display field of view, or a decrease in the number of views, or both. An increased total display field of view may require more power consumption, as a greater volume of viewing space is being illuminated.

Adjustments to the field of view may be accompanied by adjustments to one or more of color resolution, temporal resolution and spatial resolution. The output settings of field of view adjuster 64C may comprise one or more of: field of view 53C; and one or more of color resolution 53F, temporal resolution 53G, and/or spatial resolution 53H of each view.

Modules 64 may include an angular separation adjuster 64D which may generate angular separation control settings 53D to adjust the angular separation between views in response to the viewer distance from the display. For example, to ensure a smoother transition between adjacent views it may be desirable to decrease the angular separation between views if viewer tracking information 51A indicates that the viewers have increased their distance from the display.

Modules 64 may include a power management unit 64E. In response to viewer tracking information 51A, power management unit 64E may generate power settings 53E to disable, dim, or turn off for certain intervals, light sources for views which are not being currently observed. For example, for an MVD capable of displaying up to 80 views, and a single viewer observing the display, it is only necessary to illuminate two of the views corresponding to the viewer's eye positions. Where the light source of the MVD is shared between the 80 views (e.g. as in some types of DLP displays), power settings 53E may include an indication to turn off the light source through the transition for the 78 views which are not being observed. The light source of the display can therefore be off for 78/80 of the time, corresponding to a power usage of 2.5% of the power required to display all 80 views. With 2 viewers (i.e. 4 views), the power requirement increases to 5%. Even with 10 viewers, the power usage is only 25% of what would be required to display all 80 views.

Modules 64 may include a multiview management unit 64F for determining the distribution of the MVD system resolutions (e.g. color, temporal, spatial or view resolution) based on input parameters 51. Multiview management unit 64F may use look-up table 75 to determine output settings 53 for a given set of parameters 51.

Figure 6A:
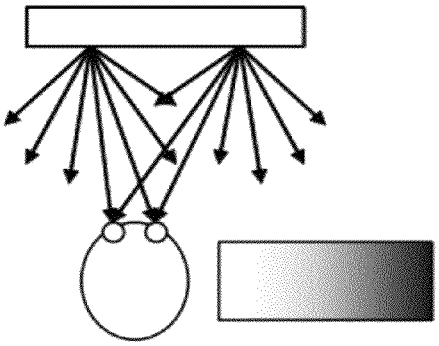
FIGS. 6A and 6B illustrate the differences in image quality between 2D and 3D images for a multiview display.

For 2D image content, multiview management unit 64F may provide output settings 53 directing the MVD to display the same high-quality 2D image at each view location (see FIG. 6A). The high-quality image may be displayed with default color, temporal and spatial resolutions within the display constraints.

Figure 6B:
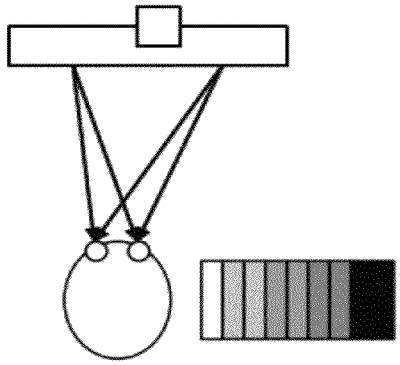

For 3D image content, the display produces twice the number of views as compared with 2D image display, given that different left and right eye views are displayed to each viewer. Therefore, as compared with 2D image display, 3D image display will result in some reduction in image quality given the display constraints (see FIG. 6B). It can be appreciated that a further reduction in image quality may occur for the display of multiview image content. For multiview image display, multiview management unit 64F may adjust the view resolution or certain aspects of image quality (e.g. color, temporal or spatial resolution) based on input parameters 51. For example, for source content comprising a news broadcast, the image quality may not be as important as being able to move around the room freely, so it may be desirable to present all possible views at reduced quality. On the other hand, for source content comprising a movie, the viewer is generally seated in a fixed location, so it may be desirable to increase the image quality within a more limited field of view.

In some cases, to increase view resolution or image quality, multiview management unit 64F may generate control settings for the MVD directing that the content be displayed at lower temporal or spatial resolution. For example, some content is captured at lower speeds (i.e., a lower temporal resolution) than can be produced by the display. This may free up display hardware to allow display of an increased number of views or views having increased spatial resolution.

Multiview management unit 64F may extract metadata associated with the image content which indicates which aspect of the MVD system resolutions can be most easily reduced to achieve minimal effect on the viewer. In some embodiments, multiview management unit 64F may have access to a database providing such information.

Modules 64 are not necessarily operated in isolation. Two or more of modules 64 may be operated in combination to determine output settings 53 for the MVD. For example, view minimizer 64A and power management unit 64E may be operated to (a) reduce the number of views to free up display hardware for allocation toward color, temporal and/or spatial resolutions (thereby increasing aspects of the image quality) and (b) reduce power consumption by enabling only those views which are currently being observed. As another example, multiview management unit 64F may, in determining the distribution between color, temporal and/or spatial resolutions, also call into operation field of view adjuster 64C and/or angular separation adjuster 64D so as to improve certain aspects of the viewing experience during the display of multiple views.

Figure 7:
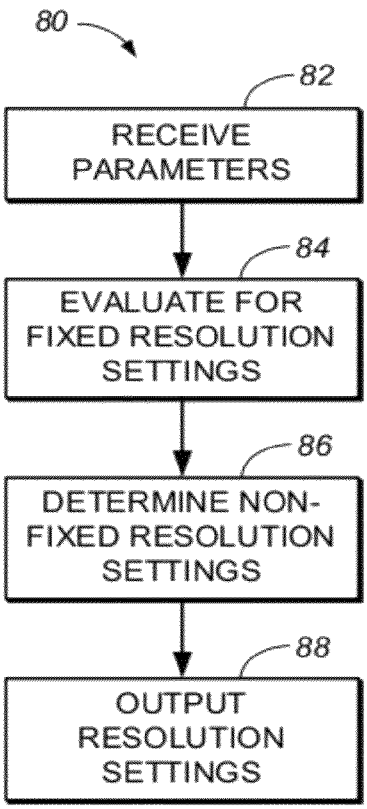
FIG. 7 is a flow chart of a method of determining resolution settings for a multiview display according to one example embodiment.

FIG. 7 illustrates a method 80 of determining resolution settings for an MVD according to an example embodiment. Method 80 may be performed by resolution management unit 34 of FIG. 1, or a module 64 (e.g. module 64A or 64F) of resolution manager 37 of FIG. 2, for example. Method 80 begins by receiving parameters at block 82. Such parameters may include, for example, one or more of the parameters received at inputs 15 of FIG. 1 or inputs 52 of FIG. 2. Based on such parameters, method 80 proceeds by determining at block 84 whether any of the MVD system resolution settings or related settings (e.g. field of view or angular separation between views) are to be fixed or set at a minimum value. For example, the view resolution may be fixed to accommodate a certain number of viewers detected observing the display. Spatial resolution of each view may be fixed to minimum spatial resolution dimensions if specified by the content metadata. User preferences may be provided specifying minimum resolution settings for one or more resolution types (color, temporal, spatial and/or view).

Given the input parameters and fixed resolutions, the non-fixed resolution settings are determined at block 86. Management of the trade-offs between the resolution settings may be handled at block 86 having regard to the priority levels assigned to each resolution setting, as determined from input parameters or user preferences. Management of such trade-offs may be handled using databases or look-up tables containing optimal resolution settings. At block 88, the resolution settings are output to the MVD.

Figure 8:
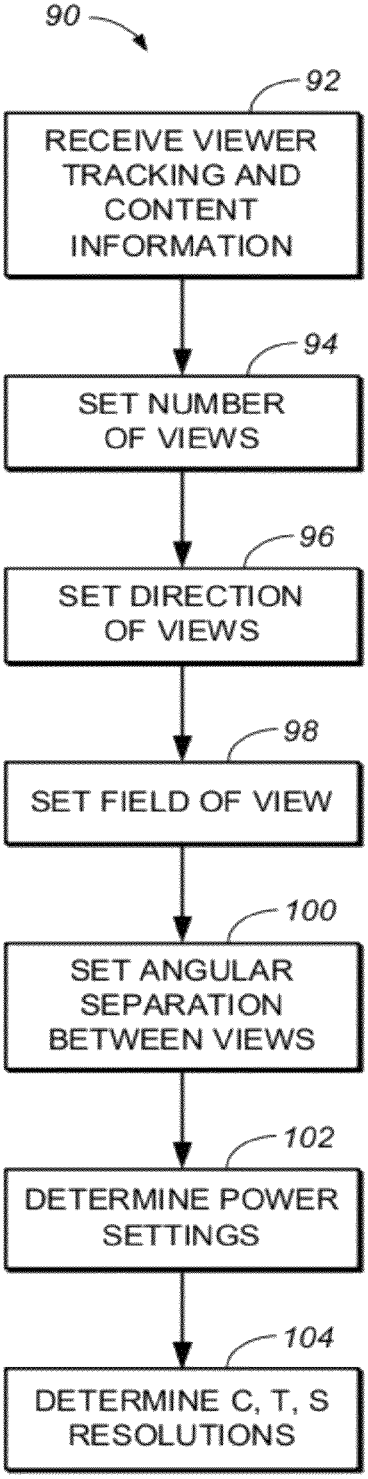
FIG. 8 is a flow chart of a method of determining resolution settings for a multiview display according to another example embodiment.

FIG. 8 illustrates a method 90 of determining resolution settings for an MVD according to another example embodiment. Method 90 may be performed by resolution management unit 34 of FIG. 1, or by resolution manager 37 of FIG. 2, for example. Method 90 begins by receiving viewer tracking information and content information at block 92. Method 90 then sets the number of views at block 94 based on the number of viewers detected observing the display, or based on other criteria (e.g. user preferences, content metadata, etc.), up to a predetermined maximum number of views. Method 90 proceeds to block 96 by setting the directions of the views. The directions may be based on the viewers' locations.

At blocks 98 and 100, the field of view and angular separation between views, respectively, may optionally be set based on viewer tracking information and/or content information. At block 102, power settings may be determined to manage power consumption of the MVD based on the number of viewers. For example if there are less viewers than the number of views, then the light source(s) of the display may be dimmed or disabled, or turned off through the transition for views that are not being viewed. At block 104, color, temporal and spatial resolution settings may be determined, based on parameters provided by the content information (e.g. for certain types of content it may be desirable to have higher color or spatial resolution).

The methods, apparatus and systems described herein may initialize the resolution settings to default settings for the MVD, or to previously determined values. Based on parameters provided by viewer tracking information and a content analyzer, the resolution settings may be updated periodically and/or upon detection of a significant change (e.g. the number of viewers changes, or the content type changes, etc.). In this manner the methods, systems and apparatus described herein dynamically determine settings for an MVD related to each of the color, temporal, spatial and/or view resolutions. The viewing experience may be improved by managing trade-offs between each of the resolutions. The MVD may have an increased energy efficiency by determining power settings based on viewer tracking information.

In some embodiments, the resolution settings may not be equally distributed between views. For example, the MVD may direct a high density of views toward a centrally located viewer, and a low density of views in the "periphery" of the display. Similarly, color, spatial and/or temporal resolutions may not be evenly distributed between views. For example, it may be desirable to provide higher quality images at particular locations (e.g. for centrally located viewers), while still providing an image to other locations (e.g. for peripherally located viewers) at lower quality. Embodiments of the resolution management system may adjust resolution settings differently for each view based on factors such as the desired image quality output for each view location and viewer position and activity.

The resolution management unit or resolution manager may be located outside of a MVD. In some embodiments, the resolution management unit or resolution manager may be integrated into a server for an IP delivery pipeline (e.g. a display management server) or at a mobile broadcast station, where it may determine the spatial resolution or frame rate, or number of views, for example. For a direct IP connection, resolution management may be performed at the source of the content (e.g. at a studio's content server).

Where a viewer position tracking system identifies one or more views that are not being observed, such views may be disabled, or the number of views reduced, as described above. In other embodiments, instead of reducing or disabling the number of views in response to viewer tracking information, the bit depth of the views which are not currently being observed may be reduced, while generally maintaining the brightness levels of the display and of each view. In some types of DLP displays, a reduction in bit depth involves a reduction of the dwell time when the lower bit depth view would be fed by the DLP chip, which may result in a decrease in the brightness level of the display.

Aspects of the invention may be provided in the form of a program product. The program product may comprise any non-transitory medium which carries a set of computer-readable information comprising instructions which, when executed by a data processor, cause the data processor to execute a method of the invention. Program products according to the invention may be in any of a wide variety of forms. The program product may comprise, for example, physical media such as magnetic data storage media including floppy diskettes, hard disk drives, optical data storage media including CD ROMs, DVDs, electronic data storage media including ROMs, flash RAM, or the like. The computer-readable information on the program product may optionally be compressed or encrypted.

Where a component (e.g. a processor, processing component, metadata extractor, content analyzer, viewer position tracking system, etc.) is referred to above, unless otherwise indicated, reference to that component (including a reference to a "means") should be interpreted as including as equivalents of that component any component which performs the function of the described component (i.e., that is functionally equivalent), including components which are not structurally equivalent to the disclosed structure which perform the function in the illustrated exemplary embodiments.

While a number of exemplary aspects and embodiments have been discussed above, those of skill in the art will recognize certain modifications, permutations, additions and sub-combinations thereof. It is therefore intended that the following appended claims and claims hereafter introduced are interpreted to include all such modifications, permutations, additions and sub-combinations as are within their true spirit and scope.

What is claimed is:

1. A method of managing display of image data by a multiview display, comprising:

receiving one or more input parameters;

wherein the input parameters comprise at least one or more of: viewer tracking information and content information associated with the image data;

wherein the content information indicates minimum resolution settings for the image data for one or more of color, temporal, spatial and view resolutions;

evaluating the input parameters to determine a plurality of views to be rendered by the display;

establishing an overall resolution of the display to which individual resolution of individual views in the plurality of views are to be collectively constrained, the individual resolution of the individual views in the plurality of views including individual color resolutions of the individual views in the plurality of views;

determining a resolution mapping between the individual resolutions and the overall resolution;

determining, based on the resolution mapping, resolution settings for each of the individual resolution of individual views in the plurality of views within constraints of the overall resolution of the display; and outputting the resolution settings to the display.

2. A method according to claim 1 wherein the resolution settings comprise at least one or more of: color, temporal, spatial and view resolutions.

3. A method according to claim 1 wherein the input parameters comprise viewer tracking information indicating viewer locations and the resolution settings comprise view resolution indicating a number of views of the display, the method comprising evaluating the viewer locations and the number of views to determine power settings for the display.

4. A method according to claim 3 wherein the power settings cause views which are not being observed to be disabled.

5. A method according to claim 4 wherein a light source of the display is dimmed or turned off for one or more periods to disable the views which are not being observed.

6. A method according to claim 3 comprising evaluating the viewer locations to determine at least one of: settings for field of view and settings for angular separation between views for output to the display.

7. A method according to claim 3 comprising, where a number of viewers observing the display is less than the view resolution, decreasing the view resolution and increasing one or more of: color, temporal, and spatial resolution of each view.

8. A method according to claim 1 wherein the content information indicates a priority level for one or more of the color, temporal, spatial and view resolutions, the method comprising preferentially allocating display hardware for each type of resolution based on the priority level.

9. An apparatus for managing display of image data by a multiview display, comprising:

a subsystem, implemented at least in part in hardware, that receives one or more input parameters;

wherein the input parameters comprise at least one of more of: viewer tracking information and content information associated with the image data;

wherein the content information indicates minimum resolution settings for the image data for one or more of color, temporal, spatial and view resolutions;

a subsystem, implemented at least in part in hardware, that evaluates the input parameters to determine a plurality of views to be rendered by the display;

a subsystem, implemented at least in part in hardware, that establishes an overall resolution of the display to which individual resolutions of individual views in the plurality of views are to be collectively constrained, the individual resolutions of the individual views in the plurality of views including individual color resolutions of the individual views in the plurality of views;

a subsystem, implemented at least in part in hardware, that determines a resolution mapping between the individual resolutions and the overall resolution;

a subsystem, implemented at least in part in hardware, that determines, based on the resolution mapping, resolution settings for each of the individual resolutions of individual views in the plurality of views within constraints of the overall resolution of the display; and a subsystem, implemented at least in part in hardware, that outputs the resolution settings to the display.

10. An apparatus according to claim 9 wherein the resolution settings comprise at least one or more of: color, temporal, spatial and view resolutions.

11. An apparatus according to claim 9 wherein the input parameters comprise viewer tracking information indicating viewer locations and the resolution settings comprise view resolution indicating a number of views of the display, the apparatus comprising a subsystem, implemented at least in part in hardware, that evaluates the viewer locations and the number of views to determine power settings for the display.

12. An apparatus according to claim 11 wherein the power settings cause views which are not being observed to be disabled.

13. An apparatus according to claim 12 wherein a light source of the display is dimmed or turned off for one or more periods to disable the views which are not being observed.

14. An apparatus according to claim 11 comprising a subsystem, implemented at least in part in hardware, that evaluates the viewer locations to determine at least one of: settings for field of view and settings for angular separation between views for output to the display.

15. An apparatus according to claim 11 comprising, where a number of viewers observing the display is less than the view resolution, a subsystem, implemented at least in part in hardware, that decreases the view resolution and increases one or more of: color, temporal, and spatial resolution of each view.

16. An apparatus according to claim 9 wherein the content information indicates a priority level for one or more of the color, temporal, spatial and view resolutions, the apparatus comprising a subsystem, implemented at least in part in hardware, that preferentially allocates display hardware for each type of resolution based on the priority level.

* * * * *